US007318413B2

(12) United States Patent
Iwahashi

(10) Patent No.: US 7,318,413 B2
(45) Date of Patent: Jan. 15, 2008

(54) CONTROL APPARATUS FOR INTERNAL COMBUSTION ENGINE

(75) Inventor: Takeshi Iwahashi, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 46 days.

(21) Appl. No.: 11/447,025

(22) Filed: Jun. 6, 2006

(65) Prior Publication Data

US 2006/0272618 A1 Dec. 7, 2006

(30) Foreign Application Priority Data

Jun. 7, 2005 (JP) ..... 2005-167286

(51) Int. Cl.
*F02B 7/00* (2006.01)
*F02B 7/04* (2006.01)

(52) U.S. Cl. ..... 123/431; 123/506

(58) Field of Classification Search ..... 123/431, 123/299, 495, 446, 506, 456, 496, 339.1; 73/119 A See application file for complete search history.

(56) References Cited

U.S. PATENT DOCUMENTS 5,277,156 A 1/1994 Osuka et al.
5,755,207 A * 5/1998 Kushibe ..... 123/478
6,314,945 B1 * 11/2001 Sugiyama et al. ..... 123/506
7,201,145 B2 * 4/2007 Matsumura ..... 123/430
2004/0007213 A1 1/2004 Oono
2005/0072405 A1 4/2005 Kojima et al.
2005/0235958 A1 10/2005 Matsumura
2007/0000478 A1 * 1/2007 Sadakane et al. ..... 123/431
2007/0006849 A1 * 1/2007 Mashiki ..... 123/457

FOREIGN PATENT DOCUMENTS

EP 0 501 463 A2 9/1992
EP 1 520 981 A2 4/2005
JP A 09-158766 6/1997
JP A-2001-041088 2/2001

OTHER PUBLICATIONS

U.S. Appl. No. 11/474,343, filed Jun. 26, 2006 in the name of Shinji Sadakane et al.

* cited by examiner

*Primary Examiner*—Mahmoud Gimie
(74) *Attorney, Agent, or Firm*—Oliff & Berridge, PLC

(57) ABSTRACT

An engine ECU executes a program including the steps of: detecting an engine speed NE and an engine load (S100, S110); when determination is made of being in an idle region based on the engine speed NE and engine load (YES at S120), determining whether in a high load idle region or a low load idle region (S130); reducing the operation sound by stopping a high-pressure fuel pump in a high load idle region (S150); and aiming for combustion stabilization without stopping the high-pressure fuel pump in a low load idle region (S170).

22 Claims, 9 Drawing Sheets

CONTROL APPARATUS FOR INTERNAL COMBUSTION ENGINE

This nonprovisional application is based on Japanese Patent Application No. 2005-167286 filed with the Japan Patent Office on Jun. 7, 2005, the entire contents of which are hereby incorporated by reference.

BACKGROUND OF THE INVENTION

1. Field of the Invention

The present invention relates to a control apparatus for an internal combustion engine including a fuel injection mechanism (in-cylinder injector) injecting fuel at high pressure into a cylinder, or an internal combustion engine including, in addition to the aforementioned fuel injection mechanism, another type of fuel injection mechanism (intake manifold injector) injecting fuel towards an intake manifold or intake port. Particularly, the present invention relates to control of an internal combustion engine in an idling mode.

2. Description of the Background Art

There is known an engine including a first fuel injection valve (in-cylinder injector) for injecting fuel into the combustion chamber of a gasoline engine and a second fuel injection valve (intake manifold injector) to inject fuel into an intake manifold, wherein the in-cylinder injector and the intake manifold injector partake in fuel injection according to the engine speed and internal combustion engine load. There is also known a direct injection engine including only a fuel injection valve (in-cylinder injector) to inject fuel into the combustion chamber of the gasoline engine. In a high-pressure fuel system including an in-cylinder injector, fuel having pressure increased by a high-pressure fuel pump is supplied to the in-cylinder injector via a delivery pipe, whereby the in-cylinder injector injects high-pressure fuel into the combustion chamber of each cylinder in the internal combustion engine.

Further, there is also known a diesel engine with a common rail type fuel injection system. In the common rail type fuel injection system, fuel having pressure increased by a high-pressure fuel pump is stored at the common rail. High-pressure fuel is injected into the combustion chamber of each cylinder in the diesel engine from the common rail by opening/closing an electromagnetic valve.

For the purpose of generating such high-pressure fuel, a high-pressure fuel pump that drives a cylinder through a cam provided at a drive shaft coupled to a crankshaft of the internal combustion engine is employed. The high-pressure fuel pump includes a pump plunger that reciprocates in a cylinder by the rotation of the cam, and a pressurizing chamber formed of the cylinder and pump plunger. To this pressurizing chamber are connected a pump supply pipe communicating with a feed pump that feeds fuel from a fuel tank, a return pipe to return the fuel flowing out from the pressurizing chamber into the fuel tank, and a high-pressure delivery pipe to deliver the fuel in the pressurizing chamber towards the in-cylinder injector. The high-pressure fuel pump is provided with an electromagnetic spill valve for opening/closing the pump supply pipe and high-pressure delivery pipe with respect to the pressurizing chamber.

When the electromagnetic spill valve is open and the pump plunger moves in the direction of increasing the volume of the pressurizing chamber, i.e. when the high-pressure fuel pump is in an intake stroke, fuel is drawn from the pump supply pipe into the pressurizing chamber. When the pump plunger moves in the direction of reducing the volume of the pressurizing chamber, i.e. when the high-pressure fuel pump is in a delivery stroke, and the electromagnetic spill valve is closed, the pump supply pipe and return pipe are cut from the pressurizing chamber, and the fuel in the pressurizing chamber is delivered to the in-cylinder injector via the high-pressure delivery pipe.

Since fuel is delivered towards the in-cylinder injector only during the period where the electromagnetic spill valve is closed in the delivery stroke in accordance with the high-pressure fuel pump, the amount of fuel pumped out can be adjusted by controlling the time to start closing the electromagnetic spill valve (adjusting the closing period of the electromagnetic spill valve). Specifically, the amount of fuel pumped out is increased by setting the time to start closing the electromagnetic spill valve earlier to increase the valve-closing period. The amount of fuel pumped out can be reduced by retarding the time to start closing the electromagnetic spill valve to shorten the valve-closing period.

By applying pressure to the fuel output from the feed pump with the high-pressure fuel pump and delivering the pressurized fuel towards the in-cylinder injector, fuel injection can be effected appropriately even for an internal combustion engine that injects fuel directly into the combustion chamber.

When the electromagnetic spill valve is to be closed in the delivery stroke of the high-pressure fuel pump, the fuel will flow, not only towards the high-pressure delivery pipe, but also towards the return pipe since the volume of the pressurizing chamber is currently reduced. If the electromagnetic spill valve is to be closed under such a state, the force by the fuel that will flow as set forth above is urged in the closing-valve operation, increasing the impact force when the electromagnetic spill valve is closed. Reflecting this increase in impact, the operation noise of the electromagnetic spill valve (the noise of the closing valve) will also become larger. This operation noise of the electromagnetic spill valve will occur continuously every time the electromagnetic spill valve is closed.

During a normal operation mode of the internal combustion engine, the continuous operation noise caused by every closing of the electromagnetic spill valve is not so disturbing since the operation noise of the internal combustion engine such as the combustion noise of the air-fuel mixture is relatively large. However, when the operation noise of the internal combustion engine per se is small such as in an idling mode of the internal combustion engine, the continuous operation noise of the electromagnetic spill valve will become so audible that the disturbance thereof can no longer be neglected.

Japanese Patent Laying-Open No. 2001-41088 discloses a fuel pump control device that can have the continuous operation noise caused at every closing of the electromagnetic spill valve reduced. The control device disclosed in this publication includes a fuel pump that draws in fuel into the pressurizing chamber and delivers the fuel towards the fuel injection valve of the internal combustion engine by altering the volume of the pressurizing chamber based on the relative movement between the cylinder and pump plunger caused by the rotation of the cam, and a spill valve for opening/closing the communication between the pressurizing chamber and the spill channel from which the fuel flows out from the pressurizing chamber. The amount of fuel pumped out towards the fuel injection valve from the fuel pump is adjusted by controlling the spill valve closing period. By controlling the spill valve based on the operation state of the internal combustion engine, the number of times of pumping out fuel by the fuel pump during a predetermined period of time can be adjusted to alter the number of times of fuel injection through the fuel injection valve per one fuel delivery. The control device includes a control unit reducing the number of times of fuel injection per one fuel delivery in a low engine load mode.

In accordance with this fuel pump control device, the required amount of fuel delivered at one time is reduced since the number of times of fuel injection per one fuel delivery is reduced in a low engine load mode where the continuous operation noise of the electromagnetic spill valve becomes relatively large. Accordingly, the time to start closing the electromagnetic spill valve can be set at a time further closer to top dead center. The cam rate indicating the relative movement between the pump plunger and the cylinder becomes smaller as a function of approaching the top dead center. Accordingly, the cam rate at the time of closing the electromagnetic spill valve can be reduced to further lower the closing noise of the electromagnetic spill valve. By lowering the closing noise of the electromagnetic spill valve, the continuous operation noise cause at every closing operation of the electromagnetic spill valve can be reduced.

Although the control device disclosed in the aforementioned publication is advantageous in that the operation noise is reduced, the operation noise will still occur when the electromagnetic spill valve of the high-pressure fuel pump closes since the high-pressure fuel pump is not stopped (i.e., the electromagnetic spill valve is continuously open) in a low engine load mode. Further, the fuel injection quantity is low such that combustion is apt to become unstable in an idle region (particularly, in an idle region at the low speed and low load side). If fuel injection from the in-cylinder injector is stopped in an idle region, deposits may accumulate at the injection hole of the in-cylinder injector.

SUMMARY OF THE INVENTION

In view of the foregoing, an object of the present invention is to provide a control apparatus for an internal combustion engine that obviates generation of an operation noise from a high-pressure pump, maintains stable combustion, and suppresses generation of deposits at the injection hole of a fuel injection mechanism during an idling mode of the internal combustion engine.

According to an aspect of the present invention, a control apparatus controls an internal combustion engine including a low-pressure pump that supplies low-pressure fuel and a high-pressure pump that supplies high-pressure fuel from a fuel tank to a fuel injection mechanism. The control apparatus includes a determination unit determining that an operation state of the internal combustion engine is in an idle state, and a control unit controlling the internal combustion engine. The control unit controls the low-pressure pump and high-pressure pump depending upon which of two or more predetermined idle states the idle state belongs to.

In accordance with the present invention, determination is made that the operation state of the internal combustion engine is in an idle state based on, for example, the engine speed and the load state of the internal combustion engine. With regards to the idle state, it is predetermined which of two or more predetermined idle states the idle state belongs to according to at least one of the engine speed and engine load. The internal combustion engine is under control depending upon which of the idle states the current idle state belongs to. Specifically, in an idle state of a lower speed and lower load side, combustion stability is given priority. The high-pressure pump is continuously operated to inject fuel of high pressure from the fuel injection mechanism to avoid increase of the fuel particles and obviate degradation of fuel diffusion. Thus, a favorable combustion state is realized. In contrast, in an idle state of a higher speed and higher load side where the problem of combustion stability is less likely to occur, the high-pressure pump is stopped to reduce the operation noise therefrom. Thus, a control apparatus for an internal combustion engine can be provided, obviating generation of an operation noise of the high-pressure pump, and maintaining stable combustion in an idling mode of the internal combustion engine.

Preferably, the control unit controls the internal combustion engine such that fuel increased in pressure by the high-pressure pump is supplied to the fuel injection mechanism when determination is made that the idle state is in a predetermined idle state of a lower load side.

In accordance with the present invention, combustion stability is given priority in an idle state of the lower load side. The operation of the high-pressure pump is continued to inject fuel of high pressure from the fuel injection mechanism, whereby a favorable combustion state can be realized.

Further preferably, the control unit controls the internal combustion engine such that fuel increased in pressure by the high-pressure pump is supplied to the fuel injection mechanism when determination is made that the idle state is in a predetermined idle state of a lower speed side.

In accordance with the present invention, combustion stability is given priority in an idle state of the lower speed side. The operation of the high-pressure pump is continued to inject fuel of high pressure from the fuel injection mechanism, whereby a favorable combustion state can be realized.

Further preferably, the control unit controls the internal combustion engine such that increase of fuel in pressure by the high-pressure pump is suppressed and fuel pressurized by the low-pressure pump is supplied to the fuel injection mechanism when determination is made that the idle state is in a predetermined idle state of a higher load side.

According to the present invention, increase of fuel in pressure by the high-pressure pump is suppressed (including suspension) to reduce generation of an operation noise of the high-pressure pump since the problem of degradation in combustion stability is unlikely to occur in an idle state of a higher load side.

Further preferably, the control unit controls the internal combustion engine such that increase of fuel in pressure by the high-pressure pump is suppressed and fuel pressurized by the low-pressure pump is supplied to the fuel injection mechanism when determination is made that the idle state is in a predetermined idle state of a higher load side.

According to the present invention, increase of the fuel in pressure by the high-pressure pump is suppressed (including suspension) to reduce generation of an operation noise of the high-pressure pump since the problem of degradation in combustion stability is unlikely to occur in an idle state of the higher speed side.

According to another aspect of the present invention, a control apparatus controls an internal combustion engine including a low-pressure pump that supplies low-pressure fuel and a high-pressure pump that supplies high-pressure fuel from a fuel tank to a fuel injection mechanism. The control apparatus includes a determination unit determining that an operation state of the internal combustion engine is in an idle state, a state determination unit determining a state of a fuel injection hole of the fuel injection mechanism, and a control unit controlling the internal combustion engine. The control unit controls the internal combustion engine such that increase of fuel in pressure by the high-pressure pump is suppressed and fuel pressurized by the low-pressure pump is supplied to the fuel injection mechanism when determination is made that the operation state of the internal combustion engine is in an idle state, and determination is made that the fuel injection hole is in a normal state.

In accordance with the present invention, determination is made that the operation state of the internal combustion engine is in an idle state based on, for example, the engine speed and load state of the internal combustion engine. When the operation state is in an idle state and the injection hole of the fuel injection mechanism is in a normal state (for example, no deposits are generated in the neighborhood of the injection hole), reducing the operation noise of the high-pressure pump is given priority than injecting fuel of high pressure from the fuel injection mechanism to blow away deposits. Therefore, increase of fuel in pressure by the high-pressure pump is suppressed. Thus, a control apparatus for an internal combustion engine can be provided, obviating generation of an operation noise of the high-pressure pump, and preventing generation of deposits at the injection hole of the fuel injection mechanism when the internal combustion engine is in an idle mode.

Preferably, the high-pressure pump includes a spill valve having its opening and closure controlled by the control unit. The control unit controls the high-pressure pump to suppress increase of fuel in pressure by the high-pressure pump by reducing the frequency of closing the spill valve.

In accordance with the present invention, generation of the operation noise of the high-pressure pump can be suppressed since the number of times of closing the spill valve that is the cause of generating the operation noise from the high-pressure pump is reduced.

Further preferably, the control unit controls the internal combustion engine such that fuel increased in pressure by the high-pressure pump is supplied to the fuel injection mechanism when determination is made that the operation state of the internal combustion engine is in an idle state, and determination is made that the fuel injection hole is not in a normal state.

According to the present invention, determination is made that the operation state of the internal combustion engine is in an idle state based on, for example, the engine speed and load state of the internal combustion engine. When the operation state of the internal combustion engine is in an idle state and the injection hole of the fuel injection mechanism is not in a normal state (for example, when deposits are generated at the neighborhood of the injection hole), injecting fuel of high pressure from the fuel injection mechanism to blow away deposits is given priority than reducing the operation noise of the high-pressure pump. Therefore, the pressure of the fuel is increased by the high-pressure pump to inject fuel of high pressure from the fuel injection mechanism, allowing deposits to be blown away. Thus, a control apparatus for an internal combustion engine can be provided, obviating generation of an operation noise of the high-pressure pump, and suppressing generation of deposits at the injection hole of the fuel injection mechanism.

More preferably, the fuel injection mechanism is a first fuel injection mechanism injecting fuel into a cylinder. The internal combustion engine further includes a second fuel injection mechanism that injects fuel into an intake manifold.

In accordance with the present invention, there can be provided a control apparatus for an internal combustion engine that includes only a first fuel injection mechanism injecting fuel into a cylinder, as well as for an internal combustion engine that includes a first fuel injection mechanism injecting fuel into a cylinder and a second fuel injection mechanism injecting fuel into an intake manifold to obviate generation of an operation noise of the high-pressure pump, maintain stable combustion, and suppress generation of deposits at the injection hole of the fuel injection mechanism in an idling mode of the internal combustion engine.

Further preferably, the first fuel injection mechanism is an in-cylinder injector, and the second fuel injection mechanism is an intake manifold injector.

In accordance with the present invention, there can be provided a control apparatus for an internal combustion engine that has an in-cylinder injector and an intake manifold injector qualified as the first fuel injection mechanism and the second fuel injection mechanism, respectively, provided independently, for partaking in fuel injection to obviate generation of an operation noise of the high-pressure pump, maintain stable combustion, and suppress generation of deposits at the injection hole of the fuel injection mechanism in an idling mode of the internal combustion engine.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
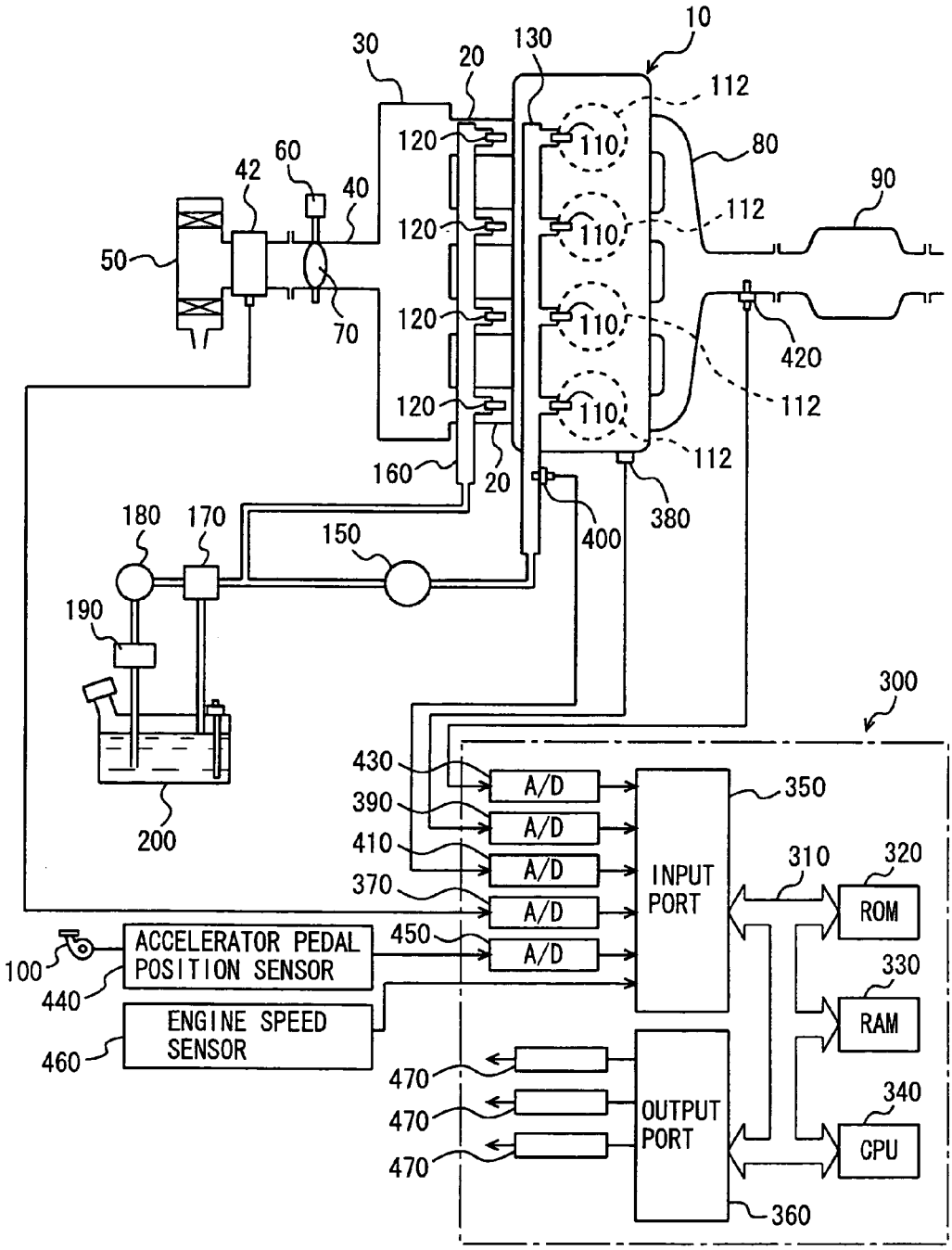
FIG. 1 is a schematic configuration diagram of an engine system under control of a control apparatus according to a first embodiment of the present invention.

Embodiments of the present invention will be described hereinafter with reference to the drawings. The same elements have the same reference characters allotted. Their designation and function are also identical. Therefore, detailed description thereof will not be repeated.

First Embodiment

FIG. 1 schematically shows a configuration of an engine system under control of an engine ECU (Electronic Control Unit) qualified as a control apparatus for an internal combustion engine according to a first embodiment of the present invention. Although an in-line 4-cylinder gasoline engine is shown in FIG. 1, application of the present invention is not limited to the engine shown, and a V-type 6-cylinder engine, a V-type 8-cylinder engine, an in-line 6-cylinder engine, and the like may be employed. The present invention is applicable as long as the engine includes an in-cylinder injector for each cylinder.

Referring to FIG. 1, an engine 10 includes four cylinders 112, which are all connected to a common surge tank 30 via intake manifolds 20, each corresponding to a cylinder 112. Surge tank 30 is connected to an air cleaner 50 via an intake duct 40. An air flow meter 42 is arranged together with a throttle valve 70 driven by an electric motor 60 in intake duct 40. Throttle valve 70 has its opening controlled based on an output signal of engine ECU 300, independent of an accelerator pedal 100. A common exhaust manifold 80 is coupled to each cylinder 112. Exhaust manifold 80 is coupled to a three-way catalytic converter 90.

There are provided for each cylinder 112 an in-cylinder injector 110 to inject fuel into a cylinder, and an intake manifold injector 120 to inject fuel towards an intake port and/or an intake manifold. Each of injectors 110 and 120 is under control based on an output signal from engine ECU 300. Each in-cylinder injector 110 is connected to a common fuel delivery pipe 130. Fuel delivery pipe 130 is connected to a high-pressure fuel pumping device 150 of an engine-drive type via a check valve that permits passage towards fuel delivery pipe 130. The present embodiment will be described based on an internal combustion engine having two injectors provided individually. It will be understood that the present invention is not limited to such an internal combustion engine. An internal combustion engine including one injector having both an in-cylinder injection function and intake manifold injection function may be employed. Further, high-pressure fuel pumping device 150 is not limited to an engine driven type, and may be a motor-driven high-pressure pump.

As shown in FIG. 1, high-pressure fuel pumping device 150 has its discharge side coupled to the intake side of fuel delivery pipe 130 via an electromagnetic spill valve. This electromagnetic spill valve is configured such that the amount of fuel supplied from high-pressure fuel pumping device 150 into fuel delivery pipe 130 increases as the opening of the electromagnetic spill valve is smaller, and the supply of fuel from high-pressure fuel pumping device 150 into fuel delivery pipe 130 is stopped when the electromagnetic spill valve is completely open. The electromagnetic spill valve is under control based on an output signal from engine ECU 300. The details will be described afterwards.

Each intake manifold injector 120 is connected to a common fuel delivery pipe 160 corresponding to a low pressure side. Fuel delivery pipe 160 and high-pressure fuel pumping device 150 are connected to an electric motor driven type low-pressure fuel pump 180 via a common fuel pressure regulator 170. Low-pressure fuel pump 180 is connected to a fuel tank 200 via a fuel filter 190. Fuel pressure regulator 170 is configured such that, when the pressure of the fuel discharged from low-pressure fuel pump 180 becomes higher than a preset fuel pressure, the fuel output from low-pressure fuel pump 180 is partially returned to fuel tank 200. Thus, fuel pressure regulator 170 functions to prevent the pressure of fuel supplied to intake manifold injector 120 and the pressure of fuel supplied to high-pressure fuel pumping device 150 from becoming higher than the set fuel pressure.

Engine ECU 300 is formed of a digital computer, and includes a ROM (Read Only Memory) 320, a RAM (Random Access Memory) 330, a CPU (Central Processing Unit) 340, an input port 350, and an output port 360, connected to each other via a bidirectional bus 310.

Air flow meter 42 generates an output voltage in proportion to the intake air. The output voltage of air flow meter 42 is applied to input port 350 via an A/D converter 370. A coolant temperature sensor 380 that generates an output voltage in proportion to the engine coolant temperature is attached to engine 10. The output voltage of coolant temperature sensor 380 is applied to input port 350 via an A/D converter 390.

A fuel pressure sensor 400 that generates an output voltage in proportion to the fuel pressure in fuel delivery pipe 130 is attached to fuel delivery pipe 130. The output voltage of fuel pressure sensor 400 is applied to input port 350 via an A/D converter 410. An air-fuel ratio sensor 420 that generates an output voltage in proportion to the oxygen concentration in the exhaust gas is attached to an exhaust manifold 80 upstream of three-way catalytic converter 90. The output voltage of air-fuel ratio sensor 420 is applied to input port 350 via an A/D converter 430.

Air-fuel ratio sensor 420 in the engine system of the present embodiment is a full-range air-fuel ratio sensor (linear air-fuel ratio sensor) that generates an output voltage in proportion to the air fuel ratio of the air-fuel mixture burned in engine 10. For air-fuel ratio sensor 420, an $O_2$ sensor may be used, which detects, in an ON/OFF manner, whether the air-fuel ratio of the mixture burned in engine 10 is rich or lean with respect to the stochiometric ratio.

Accelerator pedal 100 is connected to an accelerator position sensor 440 that generates an output voltage in proportion to the press-down of accelerator pedal 100. The output voltage of accelerator position sensor 440 is applied to input port 350 via an A/D converter 450. An engine speed sensor 460 generating an output pulse representing the engine speed is connected to input port 350. ROM 320 of engine ECU 300 prestores, in the form of a map, values of fuel injection quantity that are set corresponding to operation states based on the engine load factor and engine speed obtained by accelerator position sensor 440 and engine speed sensor 460 set forth above, correction values based on the engine coolant temperature, and the like.

The fuel supply mechanism of engine 10 set forth above will be described hereinafter with reference to FIG. 2. The fuel supply mechanism includes a feed pump 1100 (equivalent to low-pressure fuel pump 180 of FIG. 1) provided at fuel tank 200 to supply fuel at a low discharge level (approximately 400 kPa that is the pressure of the pressure regulator), a high-pressure fuel pumping device 150 (high-pressure fuel pump 1200) driven by a cam 1210, a high pressure delivery pipe 1110 (equivalent to fuel delivery pipe 130 of FIG. 1) provided to supply high-pressure fuel to in-cylinder injector 110, an in-cylinder injector 110, one provided for each cylinder, at a high-pressure delivery pipe 1110, a low-pressure delivery pipe 1120 provided to supply pressure to intake manifold injector 120, and an intake manifold injector 120, one provided for the intake manifold of each cylinder, at low-pressure delivery pipe 1120.

Feed pump 1100 of fuel tank 200 has its discharge outlet connected to low-pressure supply pipe 1400, which branches into a low-pressure delivery communication pipe 1410 and a pump supply pipe 1420. Low-pressure delivery communication pipe 1410 is connected to low-pressure delivery pipe 1120 provided at intake manifold injector 120.

Pump supply pipe 1420 is connected to the entrance of high-pressure fuel pump 1200. A pulsation damper 1220 is provided at the front of the entrance of high-pressure fuel pump 1200 to dampen the fuel pulsation.

The discharge outlet of high-pressure fuel pump 1200 is connected to a high-pressure delivery communication pipe 1500, which is connected to high-pressure delivery pipe 1100. A relief valve 1140 provided at high-pressure delivery pipe 1110 is connected to a high-pressure fuel pump return pipe 1600 via a high-pressure delivery return pipe 1610. The return opening of high-pressure fuel pump 1200 is connected to high-pressure fuel pump return pipe 1600. High-pressure fuel pump return pipe 1600 is connected to a return pipe 1630, which is connected to fuel tank 200.

Figure 2:
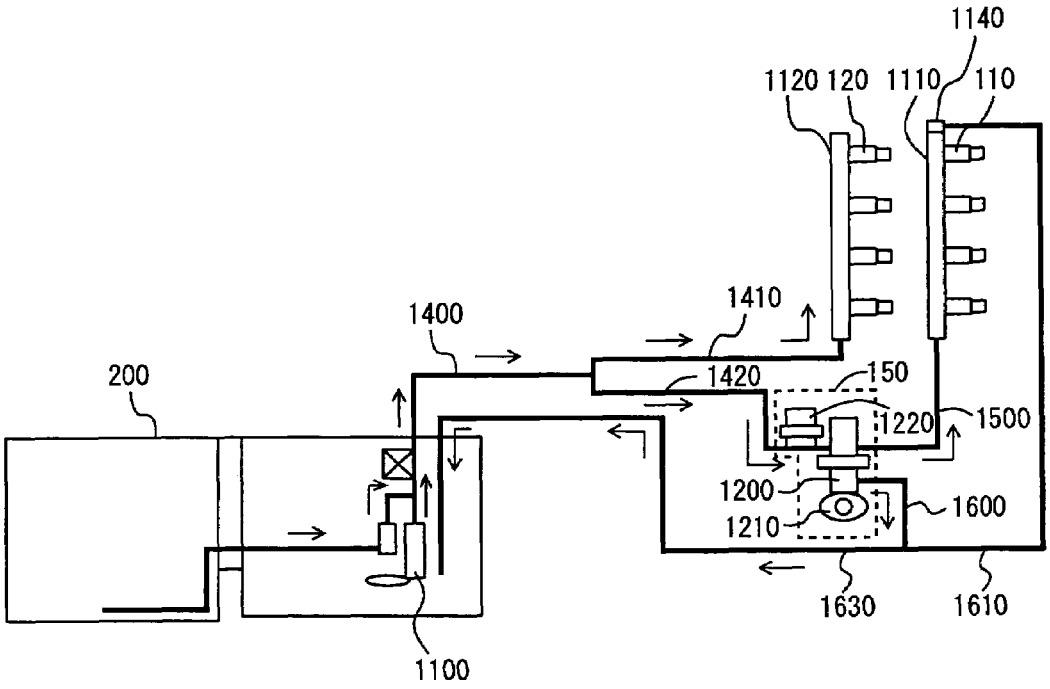
FIG. 2 schematically shows an overall view of a fuel supply mechanism of the engine system of FIG. 1.
Figure 3:
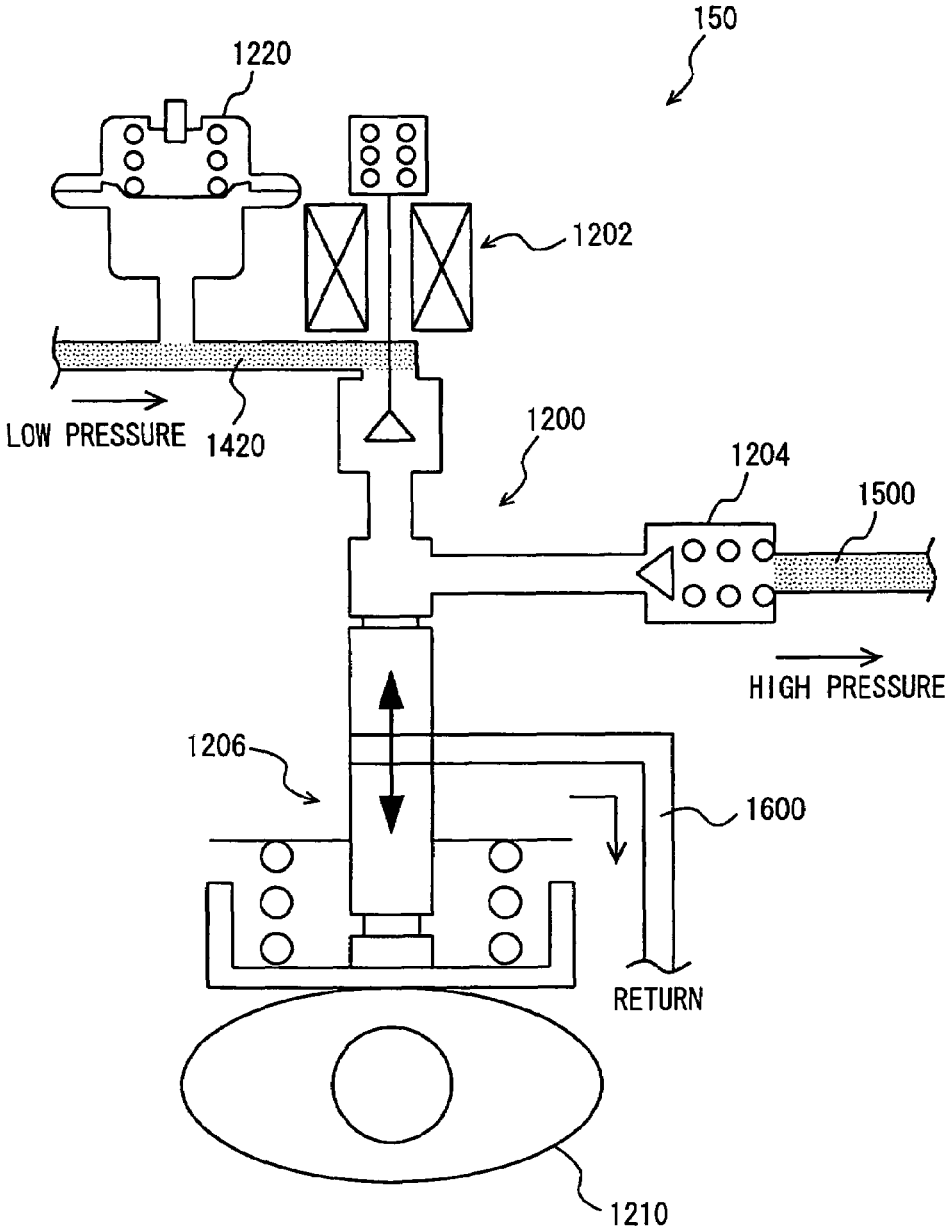
FIG. 3 is a partial enlarged view of FIG. 2.

FIG. 3 is an enlarged view of the neighborhood of high-pressure fuel pumping device 150 of FIG. 2. High-pressure fuel pumping device 150 is formed mainly of the components of high-pressure fuel pump 1200, a pump plunger 1206 driven by a cam 1210 to slide up and down, an electromagnetic spill valve 1202 and a check valve 1204 with a leak function.

When pump plunger 1206 moves downwards by cam 1210 and electromagnetic spill valve 1202 is open, fuel is introduced (drawn in). The timing of closing electromagnetic spill valve 1202 is altered when pump plunger 1206 is moving upwards by cam 1210 to control the amount of fuel discharged from high-pressure fuel pump 1200. More fuel will be discharged as the time to close electromagnetic spill valve 1202 during the pressurizing state when pump plunger 1206 is moving upwards is set earlier, and less fuel will be discharged as the time to close electromagnetic spill valve 1202 is delayed. The drive duty of electromagnetic spill valve 1202 when the discharged amount is maximum is set as 100%, whereas the drive duty of electromagnetic spill valve 1202 when the minimum amount is discharged is set as 0%. In the case where the drive duty of electromagnetic spill valve 1202 is 0%, electromagnetic spill valve 1202 maintains an open state without closing. Although pump plunger 1206 moves up and down as long as cam 1210 rotates (as long as engine 10 rotates), the fuel is not pressurized since electromagnetic spill valve 1202 does not close.

The fuel under pressure will push and open check valve 1204 (set pressure approximately 60 kPa) to be pumped towards high-pressure delivery pipe 1110 via high-pressure delivery communication pipe 1500. At this stage, the fuel pressure is feedback-controlled by fuel pressure sensor 400 provided at high-pressure delivery pipe 1110.

The duty ratio DT that is the control value to control the discharged amount of fuel of high-pressure fuel pump 1200 (the time to start closing electromagnetic spill valve 1202) will be described hereinafter. Duty ratio DT varies in the range of 0 to 100%, and relates to the cam angle of cam 1210 corresponding to the closing period of electromagnetic spill valve 1202. Specifically, the duty ratio DT indicates the ratio of the target cam angle θ to the maximum cam angle θ(0), where "θ(0)" is the cam angle corresponding to the longest closing period of electromagnetic spill valve 1202 (maximum cam angle) and "θ" is the cam angle corresponding to the target value of the closing period of electromagnetic spill valve 1202 (target cam angle). Therefore, duty ratio DT approaches 100% as the target closing period of electromagnetic spill valve 1202 (the time to start closing the valve) approximates the maximum closing period, and approaches 0% as the target closing valve period approximates "0".

As duty ratio DT approximates 100%, the time to start closing electromagnetic spill valve 1202 that is adjusted based on duty ratio DT is set earlier, such that the closing period of electromagnetic spill valve 1202 becomes longer. As a result, the amount of fuel discharged from high-pressure fuel pump 1200 increases and fuel pressure P becomes higher. In contrast, as duty ratio DT approximates 0%, the time to start closing electromagnetic spill valve 1202 that is adjusted based on duty ratio DT is delayed, so that the closing period of electromagnetic spill valve 1202 becomes shorter. As a result, the amount of fuel discharged from high-pressure fuel pump 1200 is reduced and fuel pressure P becomes lower.

Figure 4:
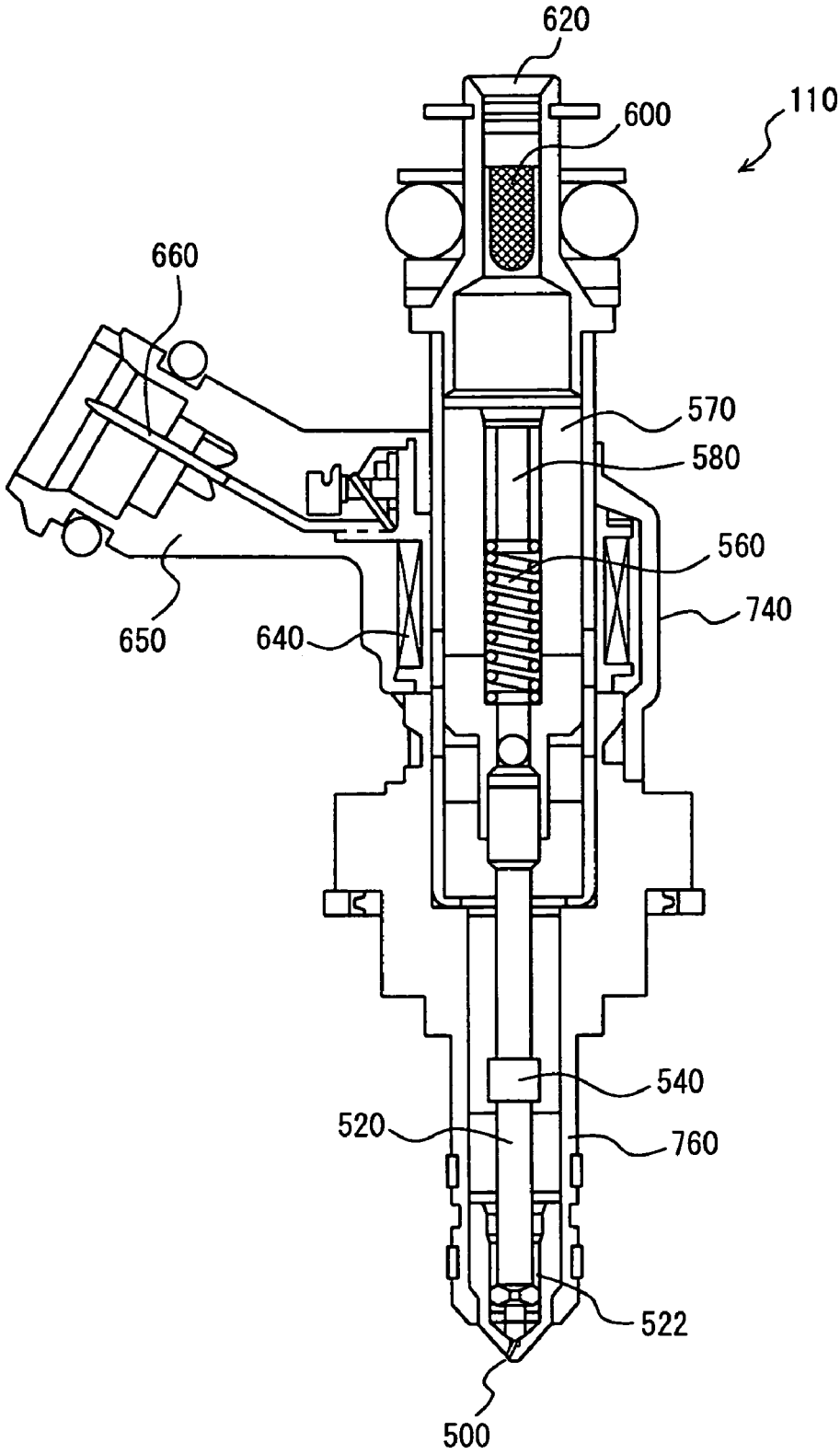
FIG. 4 is a sectional view of an in-cylinder injector.

In-cylinder injector 110 will be described hereinafter with reference to the sectional view of FIG. 4 corresponding to the vertical direction of in-cylinder injector 110.

In-cylinder injector 110 has a nozzle body 760 at a lower end of a main body 740, fixed by a nozzle holder via a spacer. Nozzle body 760 has an injection hole 500 formed at the lower end thereof. A needle 520 that can move up and down is arranged in nozzle body 760. The upper end of needle 520 abuts against a slidable core 540 in main body 740. A spring 560 urges needle 520 downswards via core 540. Needle 520 is seated at an inner circumferential seat face 522 of nozzle body 760. As a result, injection hole 500 is closed in a normal state.

A sleeve 570 is inserted and secured at the upper end of main body 740. A fuel channel 580 is formed in sleeve 570. The lower end side of fuel channel 580 communicates with the interior of nozzle body 760 via a channel in main body 740. Fuel is injected out from injection hole 500 when needle 520 is lifted up. The upper end side of fuel channel 580 is connected to a fuel introduction opening 620 via a filter 600. Fuel introduction opening 620 is connected to fuel delivery pipe 130 of FIG. 1.

An electromagnetic solenoid 640 is arranged so as to surround the lower end portion of sleeve 570 in main body 740. When a current is applied to solenoid 640, core 540 moves upwards against spring 560, whereby the fuel pressure pushes needle 520 up and injection hole 500 is open. Thus, fuel injection is effected. Solenoid 640 is taken out to a wire 660 within an insulating housing 650, so that solenoid 640 can receive an electric signal directed to valve-opening from engine ECU 300. Fuel injection from in-cylinder injector 110 cannot be effected unless this electric signal directed to valve-opening is output from engine ECU 300.

The fuel injection time and fuel injection period of in-cylinder injector 110 are controlled by an electric signal directed to valve-opening, received from engine ECU 300. By controlling the fuel injection period, the fuel injection quantity from in-cylinder injector 110 can be adjusted. In other words, control can be effected to inject a small amount of fuel (in a region of at least the minimum fuel injection quantity) by the electric signal. It is to be noted that an EDU (Electronic Driver Unit) may be provided between engine ECU 300 and in-cylinder injector 110 for such control.

Figure 5:
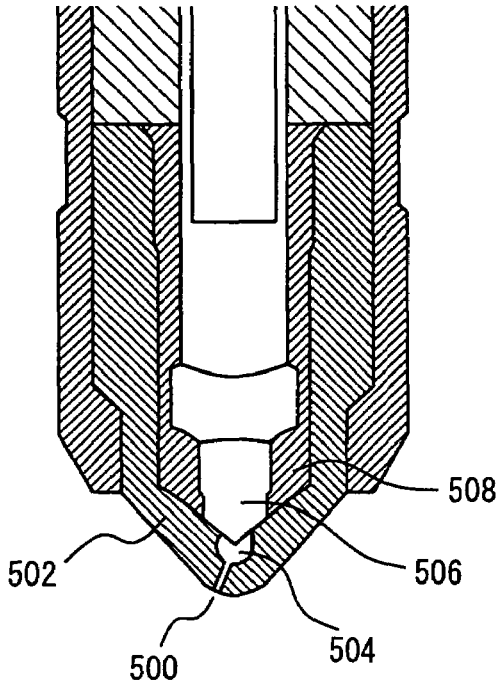
FIG. 5 is a sectional view of the leading end of an in-cylinder injector.

FIG. 5 represents a sectional view of in-cylinder injector 110 in the leading end region. A valve body 502 where injection hole 500 is provided, a suck volume 504 identified as a fuel reservoir, a needle tip 506, and a fuel reside region 508 constitute the leading end of in-cylinder injector 110.

It is considered that after fuel is injected from in-cylinder injector 110 during an intake stroke or compression stroke, a portion of fuel pushed out from fuel reside region 508 by needle tip 506 will remain in suck volume 504 without being injected outside in-cylinder injector 110 through injection hole 500. It is also considered that, if the operation of in-cylinder injector 110 is continuously ceased, fuel will leak into suck volume 504 from the sealing portion by oil tightness.

The temperature at the leading end of in-cylinder injector 110 is greatly affected by the heat from the burning gas. In view of additional factors such as heat from the head, heat radiation towards the fuel, and the like, injection hole 500 is apt to be clogged by the gradually developed carbon as the temperature becomes higher.

Since the pressure of fuel supplied to in-cylinder injector 110 having the configuration set forth above is extremely high (approximately 13 MPa), a large noise or vibration will occur at the time of opening and closing the valve. Although such a noise or vibration may not be auditory perceivable by the passenger of the vehicle on which engine 10 is mounted in the region where the load and the speed of engine 10 are high, the noise and/or vibration may be sensed by the passenger in the region where the load and speed of engine 10 are low. In this context, engine ECU 300 qualified as the control apparatus for an internal combustion engine of the present embodiment has the idle region of engine 10, when in an idle state, divided into a low load region and high load region to effect different control therebetween.

In a low load idle region, combustion stability is given priority. High-pressure fuel pump 1200 is driven to supply high-pressure fuel of approximately 2 MPa to 13 MPa to in-cylinder injector 110 from which fuel is injected into the cylinder. In a low load idle region where the fuel injection quantity is low and combustion stabilization is apt to be degraded, suspension of high-pressure fuel pump 1200 will cause the pressure of the fuel supplied to in-cylinder injector 110 to be reduced significantly. Accordingly, atomization of the fuel injected from in-cylinder injector 110 will be degraded (enlargement of fuel particles, degradation of fuel diffusion) to further increase combustion deterioration. Therefore, fuel of high pressure is directly injected into the cylinder in order to stabilize combustion in a low load idle region.

In a high load idle region, reducing the operation noise of high-pressure fuel pump 1200 is given priority (since the problem of combustion stabilization is less likely to occur). High-pressure fuel pump 1200 is stopped (duty ratio DT=0%), and low-pressure fuel of approximately 0.3 MPa is supplied by feed pump 1100 to in-cylinder injector 110. Fuel is injected from in-cylinder injector 110 or dividedly injected between in-cylinder injector 110 and intake manifold injector 120. By suspending high-pressure fuel pump 1200, the operation noise thereof is reduced.

The idle region will be described hereinafter with reference to the map of FIG. 6. The speed of engine 10 is plotted along the horizontal axis, whereas the load factor of engine 10 is plotted along the vertical axis. The idle regions are represented by the two curves (the outer curve and the inner curve). The region sandwiched between the outer curve and the inner curve corresponds to a high load idle region. The origin 0 side region, inner of the inner curve, corresponds to a low load idle region.

Various electric loads are mounted on the vehicle. The power generated by the alternator rotated by engine 10 (including the case through a battery) is supplied to these electric apparatuses. The vehicle is also equipped with an air conditioner. The compressor of this air conditioner is driven by engine 10. Such electric load and air conditioner will become the load of engine 10 in the idle region of engine 10 (for example, in the case where the vehicle is caught in a traffic tie-up or stops at red light). Therefore, when the vehicle is used in a normal manner, many of the cases will belong to a high load idle region among the plurality of idle regions.

Figure 7:
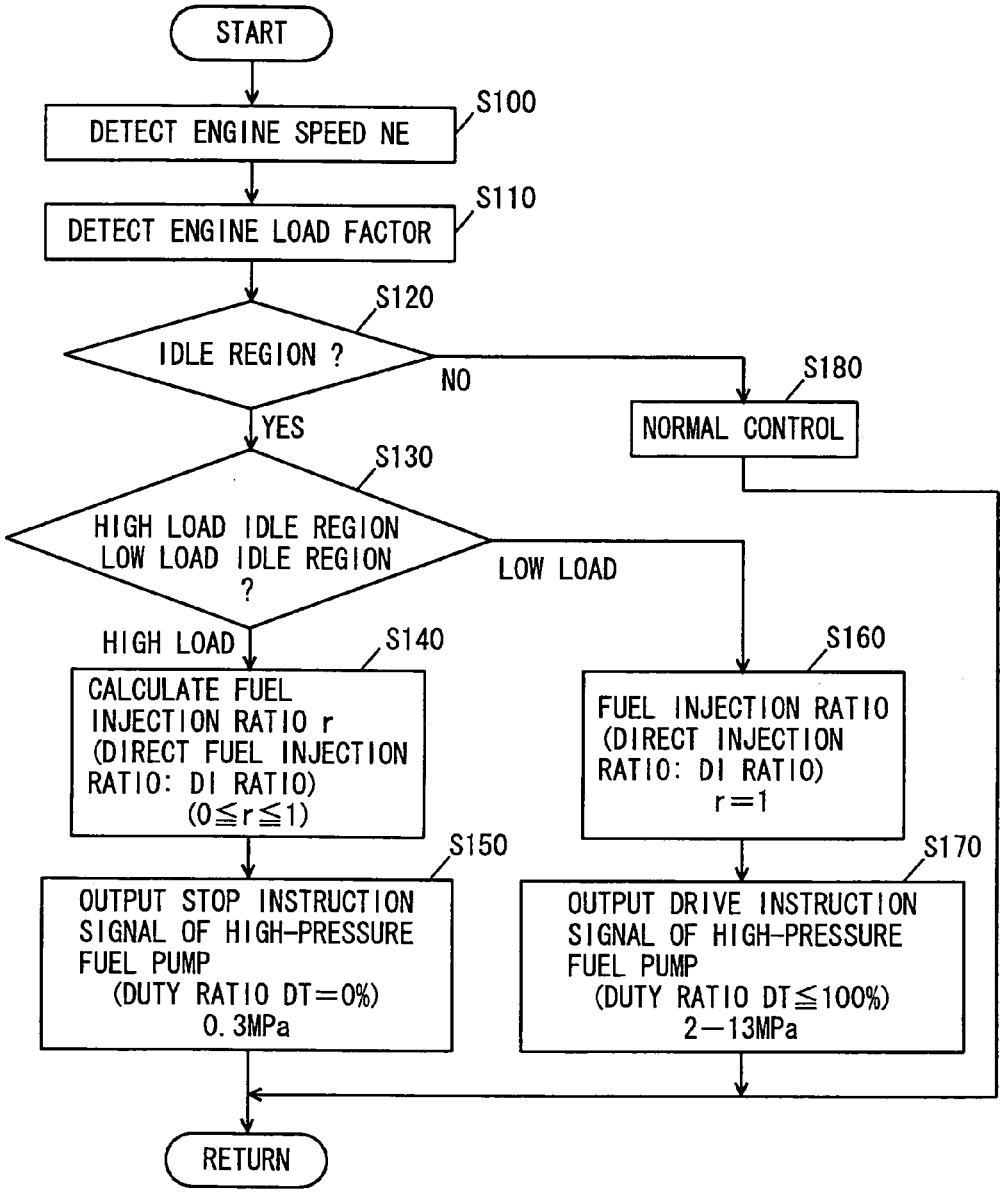
FIG. 7 is a flow chart of a control program executed by an engine ECU (Electronic Control Unit) qualified as the control apparatus according to the first embodiment of the present invention.

A control program executed by engine ECU 300 qualified as the control apparatus of the present embodiment will be described hereinafter with reference to FIG. 7.

At step (hereinafter, step abbreviated as "S" hereinafter) 100, engine ECU 300 detects engine speed NE based on a signal from speed sensor 460 of engine 10. At S110, engine ECU 300 detects the load factor of engine 10 based on a signal from accelerator pedal position sensor 440. The load factor of engine 10 does not necessarily have to be determined based on the pedal position of accelerator pedal 10 alone.

Figure 6:
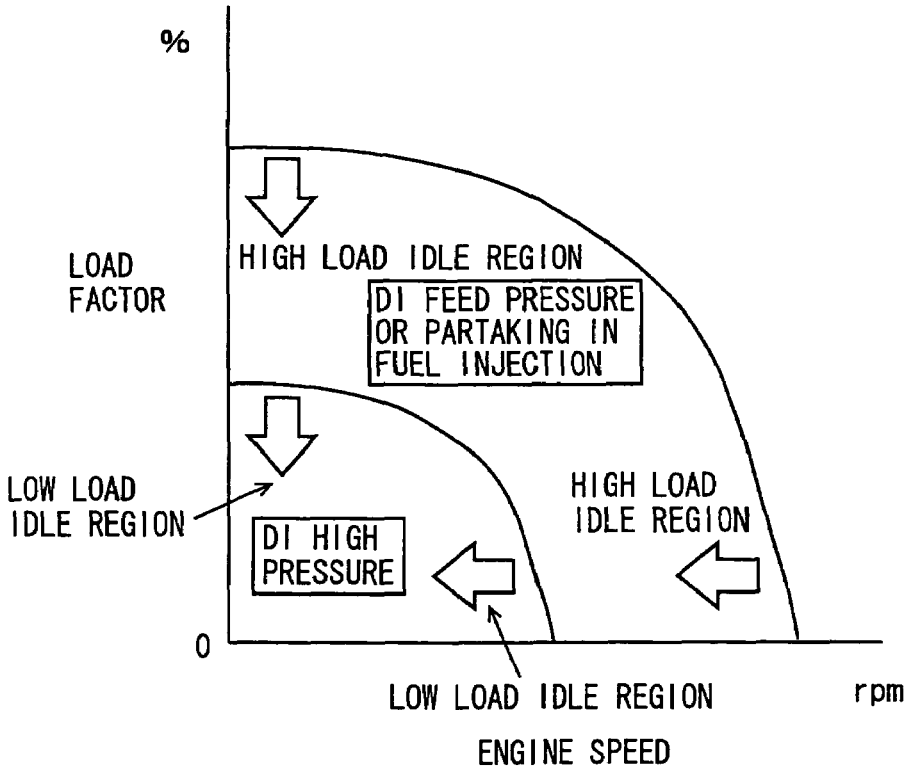
FIG. 6 is a map of an idle region of an engine.

At step S120, engine ECU 300 determines whether the current operation region of engine 10 is in an idle region or not based on the detected engine speed NE and load factor as well as the map of FIG. 6. Determination is made of being in an idle region when at the region to the origin 0 side of the outer curve in FIG. 6 (YES at step S120), and control proceeds to S130; otherwise (NO at S120), control proceeds to S180.

At S130, engine ECU 300 determines whether the current operation region of engine 10 is in a low load idle region or a high load idle region. Determination is made of being in a high load idle region when at the region sandwiched between the outer curve and the inner curve in FIG. 6 (high load at S130), and control proceeds to S140. When determination is made of being in a low load idle region when at the region to the origin 0 side of the inner curve in FIG. 6 (low load at S130), control proceeds to S160.

At S140, engine ECU 300 calculates the fuel injection ratio between in-cylinder injector 110 and intake manifold injector 120 (direct injection ratio: DI ratio) r. This fuel injection ratio will be calculated based on maps and the like that will be described afterwards. For DI ratio r, $0 \leqq r \leqq 1$ is established.

At S150, engine ECU 300 outputs a stop instruction signal of high-pressure fuel pump 1200. Specifically, a control signal corresponding to a duty ratio DT of 0% of electromagnetic spill valve 1202 is output. Accordingly, fuel pressurized at approximately 0.3 MPa by feed pump 1100 is delivered to in-cylinder injector 110.

At S160, engine ECU 300 sets the fuel injection ratio (direct injection: DI ratio) between in-cylinder injector 110 and intake manifold injector 120 to 1. Accordingly, fuel is injected from in-cylinder injector 110 alone.

At S170, engine ECU 300 outputs a drive instruction signal of high-pressure fuel pump 1200. Specifically, a control signal corresponding to a duty ratio DT (upper limit 100%) of electromagnetic spill valve 1202 is output. Accordingly, fuel pressurized to the high level of approximately 2 MPa to 13 MPa by high-pressure fuel pump 1200 is delivered to in-cylinder injector 110.

At S180, engine ECU 300 executes control of a normal operation region other than an idle region.

The operation of the internal combustion engine under control of engine ECU 300 will be described hereinafter based on the configuration and flow charts set forth above.

When engine speed NE and engine load factor are detected (S100, S110), and the current operation region of engine 10 is an idle region (YES at S120), determination is made whether the idle region is a high load idle region or a low load idle region (S130).

When the idle region corresponds to a high load idle region shown in FIG. 6 (high load at S130), the fuel injection ratio between in-cylinder injector 110 and intake manifold injector 120 is calculated (S140). A stop instruction signal of high-pressure fuel pump 1200 is output (S150), and high-pressure fuel pump 1200 is stopped. At this stage, fuel pressurized to the low level of approximately 0.3 MPa by feed pump 1100 is supplied to in-cylinder injector 110.

Since high-pressure fuel pump 1200 is stopped in a high load idle region, the operation noise of high-pressure fuel pump 1200 is reduced. In a high load idle region, the problem of combustion stability is less likely to occur as compared to a low load idle region.

When in a low load idle region shown in FIG. 6 (low load at S130), DI ratio r defined as the fuel injection ratio between in-cylinder injector 110 and intake manifold injector 120 is set to 1 (S160). A drive instruction signal of high-pressure fuel pump 1200 is output (S170), and the operation of high-pressure fuel pump 1200 is continued without stopping. At this stage, fuel pressurized to the high-level of approximately 2 MPa to 13 MPa by high-pressure fuel pump 1200 is supplied to in-cylinder injector 110.

In a low load idle region, combustion stability is given priority. The operation of high-pressure fuel pump 1200 is continued such that high-pressure fuel of approximately 2 MPa to 13 MPa is supplied to in-cylinder injector 110. High-pressure fuel is directly injected from in-cylinder injector 110. In a low load idle region where the fuel injection is low and combustion stabilization is apt to be graded, fuel of high pressure is directly injected into the cylinder to allow a favorable burning state without the fuel particles being increased and without degradation in fuel diffusion.

Even in the case where the engine operation region corresponds to an idle region, the drive and suspension of high-pressure fuel pump 1200 are controlled between a low load idle region and a high load idle region. In a low load idle region where combustion stabilization is given priority than reducing the operation noise, fuel pressurized by a high-pressure fuel pump is injected from the in-cylinder injector into the cylinder to allow combustion stabilization. In a high load idle region where the problem of combustion stabilization is relatively unlikely to occur, the high-pressure fuel pump is stopped such that fuel pressurized by a feed pump is injected into the cylinder from the in-cylinder injector (or also injected from the intake manifold injector) to allow the operation noise to be reduced.

Second Embodiment

An engine system under control of an engine ECU 300 qualified as a control apparatus for an internal combustion engine according to a second embodiment of the present invention will be described hereinafter. Engine ECU 300 of the present embodiment executes a program differing from that of the previous first embodiment. The remaining hardware configuration (FIGS. 1-5) is similar to that of the first embodiment. Therefore, details thereof will not be repeated here.

Engine ECU 300 of the present embodiment executes different control depending upon whether deposits are generated at the injection hole of in-cylinder injector 110 in an idle region.

When deposits are generated at the injection hole of in-cylinder injector 110 (or the possibility of generation is high), the high-pressure fuel pump is driven to supply high-pressure fuel of approximately 2 MPa to 13 MPA to in-cylinder injector 110 from which fuel is injected into a cylinder. Accordingly, the deposits generated at the injection hole can be blown away by the fuel of high pressure.

When deposits are not generated at the injection hole of in-cylinder injector 110 (or the possibility of generation thereof is low), the high-pressure fuel pump is stopped and low-pressure fuel of approximately 0.3 MPa is supplied to in-cylinder injector 110. Fuel is injected by in-cylinder injector 100 or dividedly by in-cylinder injector 110 and intake manifold injector 129. Accordingly, the operation noise of the high-pressure fuel pump in an idle mode can be reduced.

Figure 8:
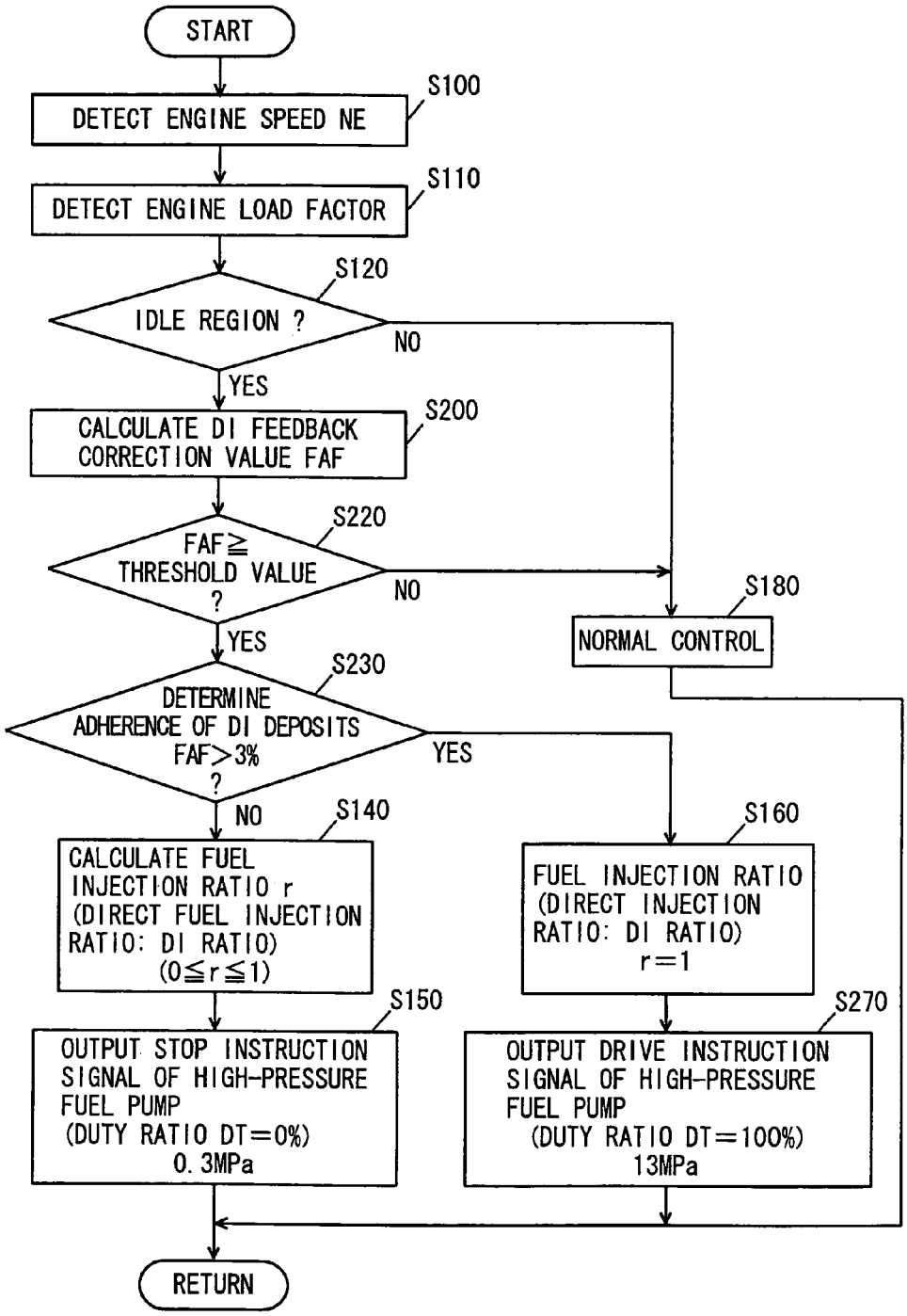
FIG. 8 is a flow chart of a control program executed by an engine ECU qualified as a control apparatus according to a second embodiment of the present invention.

A control program executed by engine ECU 300 according to the second embodiment will be described hereinafter with reference to FIG. 8. In the flow chart of FIG. 8, steps similar to those of FIG. 7 have the same step number allotted. Their contents are also identical. Therefore, detailed description thereof will not be repeated here.

At S200, engine ECU 300 calculates a feedback correction value FAF in a feedback control system that controls the fuel injection quantity from in-cylinder injector 110.

The feedback control system is realized by engine ECU 300. In the feedback control system, the required period of fuel injection to inject fuel from in-cylinder injector 110 is calculated from the calculated target fuel injection quantity of in-cylinder injector 110. During this period of fuel injection, current is applied to solenoid 640. Core 540 rises against spring 560, whereby the fuel pressure pushes up needle 520. Injection hole 500 is opened to effect fuel injection. The state amount relative to the actually injected fuel amount is detected, and the difference from the target fuel injection quantity is calculated. Feedback correction value FAF is calculated such that the difference becomes 0. A large feedback correction value FAF implies that the difference between the target fuel injection quantity and the actually injected fuel amount is great. For example, when deposits are generated at injection hole 500 of in-cylinder injector 110, the exact target fuel injection quantity will not be injected even if injection hole 500 is open for the calculated period of fuel injection due to the deposits. Therefore, feedback correction value FAF becomes larger. By monitoring feedback correction value FAF, determination can be made whether deposits are generated in the neighborhood of injection hole 500 of in-cylinder injector 110.

At S220, engine ECU 300 determines whether the obtained feedback correction value FAF is at least a threshold value. When feedback correction value FAF is at least the threshold value (YES at S220), control proceeds to S230; otherwise (NO at S220), control proceeds to S180. The threshold value is set to determine whether the control of the present embodiment (S140, S150, S160, S270) or normal control is to be executed.

At S230, engine ECU 300 determines whether generation of deposits (DI deposit adherence) has been detected in the neighborhood of injection hole 500 of in-cylinder injector 110. Specifically, determination is made of adherence of DI deposits if feedback correction value FAF is larger than 3% (YES at S230), and control proceeds to S160; otherwise (NO at S230), control proceeds to S140.

At S270, engine ECU 300 outputs a drive instruction signal of high-pressure fuel pump 1200. Specifically, a control signal corresponding to a duty ratio DT of 100% of electromagnetic spill valve 1202 is output. Accordingly, fuel pressurized to approximately 13 MPa by high-pressure fuel pump 1200 is delivered to in-cylinder injector 110. The upper limit in S270 may be set to 13 MPa.

An operation of the internal combustion engine under control of the engine ECU of the present embodiment will be described hereinafter based on the configuration and flow charts set forth above.

When engine speed NE and engine load factor are detected (S100, S110), and the current operation region of engine 10 is an idle region (YES at S120), feedback correction value FAF at the control system that feedback-controls the fuel injection quantity of in-cylinder injector 110 is calculated (S200).

When the current feedback correction value FAF of engine 10 is at least the threshold value (YES at S120), determination is made whether deposits adhere in the neighborhood of injection hole 500 of in-cylinder injector 110 based on feedback correction value FAF (S230).

When deposits do not adhere or the possibility of adherence thereof is low in the neighborhood of injection hole 500 of in-cylinder injector 110 (NO at S230), the fuel injection ratio between in-cylinder injector 110 and intake manifold injector 120 is calculated (S140). A stop instruction signal of high-pressure fuel pump 1200 is output (S150), and the operation of high-pressure fuel pump 1200 is stopped. At this stage, low-pressure fuel of approximately 0.3 MPa pressurized by feed pump 1100 is supplied to in-cylinder injector 110.

Thus, when deposits do not adhere or the possibility of adherence thereof is low in the neighborhood of injection hole 500 of in-cylinder injector 110, the operation noise of high-pressure fuel pump 1200 is reduced since operation thereof is stopped.

When deposits adhere or the possibility of adherence thereof is high in the neighborhood of injection hole 500 of in-cylinder injector 110 (YES at S230), DI ratio r defined as the fuel injection ratio between in-cylinder injector 110 and intake manifold injector 120 is set to 1 (S160). A drive instruction signal of high-pressure fuel pump 1200 is output at the duty ratio DT=100% (S270). The operation of high-pressure fuel pump 1200 is continued without stopping. At this stage, high-pressure fuel pressurized to approximately 13 MPa by high-pressure fuel pump 1200 is supplied to in-cylinder injector 110.

Thus, when deposits adhere or the possibility of adherence thereof is high in the neighborhood of injection hole 500 of in-cylinder injector 110, the operation of high-pressure fuel pump 1200 is continued such that high-pressure fuel of approximately 13 MPa is supplied to in-cylinder injector 110, whereby high-pressure fuel is directly injected into the cylinder from in-cylinder injector 110. By the direct injection of high-pressure fuel into the cylinder, the deposits generated in the proximity of injection hole 500 of in-cylinder injector 110 can be blown away.

The drive and suspension of the high-pressure fuel pump are controlled based on whether deposits are generated at the proximity of the injection hole of the in-cylinder injector when the operation region of the engine is in an idle region. In the case where deposits are generated in the neighborhood of the injection hole of the in-cylinder injector or when the possibility of generation thereof is high, removal of deposits is given priority than reducing the operation noise, even if the operation noise is significant in an idle region. Fuel pressurized by a high-pressure fuel pump is injected from the in-cylinder injector into the cylinder. In the case where deposits are not generated in the neighborhood of the injection hole of the in-cylinder injector or the possibility of generation thereof is low, the operation of the high-pressure fuel pump is stopped, and fuel pressurized by the feed pump is injected into the cylinder from the in-cylinder injector (or also from the intake manifold injector). Accordingly, the operation noise when in an idle region can be reduced.

In the process of S150 in the first and second embodiments set forth above, the operation noise is reduced by the suspension of high-pressure fuel pump 1200 (duty ratio DT 0%). The operation noise can be reduced in another manner as set forth below. Since the operation noise of high-pressure fuel pump 1200 is generated reflecting the closing of electromagnetic spill valve 1202, the operation noise of high-pressure fuel pump 1200 can be reduced by lowering the closing frequency of electromagnetic spill valve 1202 (reduce the number of times of closing the valve). In this case, the discharge pressure from high-pressure fuel pump 1200 is lower than that of a normal state.

<Engine (1) To Which Present Control Apparatus Can Be Suitably Applied>

An engine (1) to which the control apparatus of the present embodiment is suitably adapted will be described hereinafter.

Figure 9:
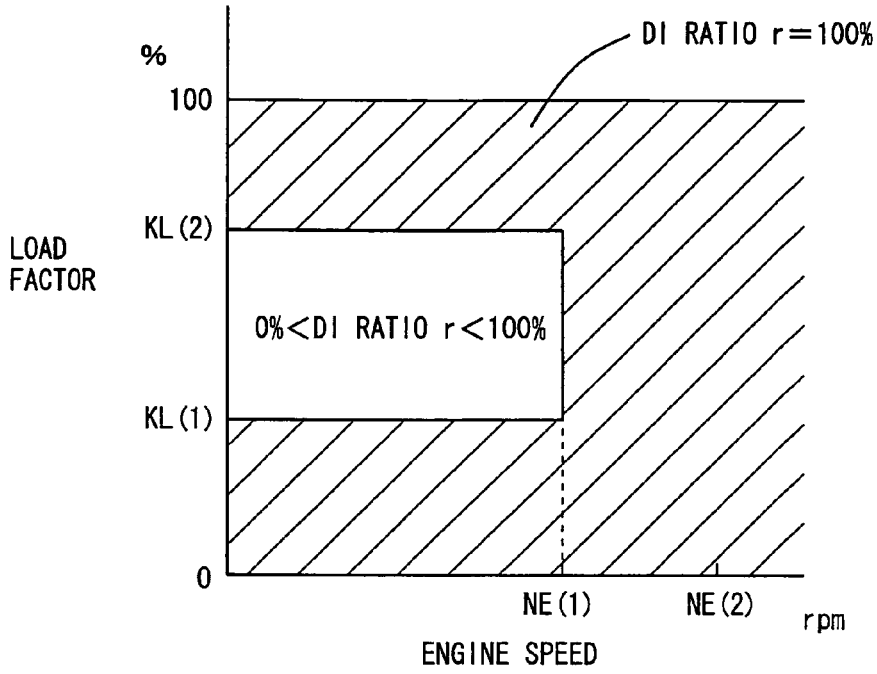
FIGS. 9 and 10 are first DI ratio maps corresponding to a warm state and a cold state, respectively, of an engine to which the control apparatus of an embodiment of the present invention is suitably adapted.
Figure 10:
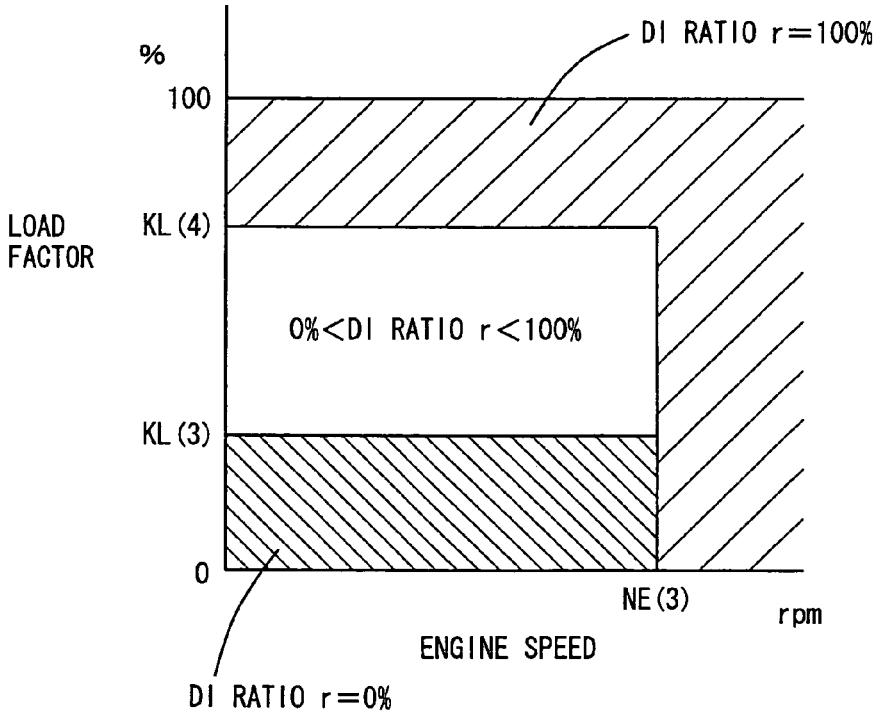

Referring to FIGS. 9 and 10, maps indicating a fuel injection ratio (hereinafter, also referred to as DI ratio (r)) between in-cylinder injector 110 and intake manifold injector 120, identified as information associated with an operation state of engine 10, will now be described. The maps are stored in ROM 320 of engine ECU 300. FIG. 9 is the map for a warm state of engine 10, and FIG. 10 is the map for a cold state of engine 10.

In the maps of FIGS. 9 and 10, the fuel injection ratio of in-cylinder injector 110 is expressed in percentage as the DI ratio r, wherein the engine speed of engine 10 is plotted along the horizontal axis and the load factor is plotted along the vertical axis.

As shown in FIGS. 9 and 10, the DI ratio r is set for each operation region that is determined by the engine speed and the load factor of engine 10. "DI RATIO r=100%" represents the region where fuel injection is carried out from in-cylinder injector 110 alone, and "DI RATIO r=0%" represents the region where fuel injection is carried out from intake manifold injector 120 alone. "DI RATIO r≠0%", "DI RATIO r≠100%" and "0%<DI RATIO r<100%" each represent the region where in-cylinder injector 110 and intake manifold injector 120 partake in fuel injection. Generally, in-cylinder injector 110 contributes to an increase of power performance, whereas intake manifold injector 120 contributes to uniformity of the air-fuel mixture. These two types of injectors having different characteristics are appropriately selected depending on the engine speed and the load factor of engine 10, so that only homogeneous combustion is conducted in the normal operation state of engine 10 (for example, a catalyst warm-up state during idling is one example of an abnormal operation state).

Further, as shown in FIGS. 9 and 10, the DI ratio r of in-cylinder injector 110 and intake manifold injector 120 is defined individually in the maps for the warm state and the cold state of the engine. The maps are configured to indicate different control regions of in-cylinder injector 110 and intake manifold injector 120 as the temperature of engine 10 changes. When the temperature of engine 10 detected is equal to or higher than a predetermined temperature threshold value, the map for the warm state shown in FIG. 9 is selected; otherwise, the map for the cold state shown in FIG. 10 is selected. In-cylinder injector 110 and/or intake manifold injector 120 are controlled based on the engine speed and the load factor of engine 10 in accordance with the selected map.

The engine speed and the load factor of engine 10 set in FIGS. 9 and 10 will now be described. In FIG. 9, NE(1) is set to 2500 rpm to 2700 rpm, KL(1) is set to 30% to 50%, and KL(2) is set to 60% to 90%. In FIG. 10, NE(3) is set to 2900 rpm to 3100 rpm. That is, NE(1)<NE(3). NE(2) in FIG. 9 as well as KL(3) and KL(4) in FIG. 10 are also set appropriately.

In comparison between FIG. 9 and FIG. 10, NE(3) of the map for the cold state shown in FIG. 10 is greater than NE(1) of the map for the warm state shown in FIG. 9. This shows that, as the temperature of engine 10 becomes lower, the control region of intake manifold injector 120 is expanded to include the region of higher engine speed. That is, in the case where engine 10 is cold, deposits are unlikely to accumulate in the injection hole of in-cylinder injector 10 (even if fuel is not injected from in-cylinder injector 110). Thus, the region where fuel injection is to be carried out using intake manifold injector 120 can be expanded, whereby homogeneity is improved.

In comparison between FIG. 9 and FIG. 10, "DI RATIO r=100%" in the region where the engine speed of engine 10 is NE(1) or higher in the map for the warm state, and in the region where the engine speed is NE(3) or higher in the map for the cold state. In terms of load factor, "DI RATIO r=100%" in the region where the load factor is KL(2) or greater in the map for the warm state, and in the region where the load factor is KL(4) or greater in the map for the cold state. This means that in-cylinder injector 110 alone is used in the region of a predetermined high engine speed, and in the region of a predetermined high engine load. That is, in the high speed region or the high load region, even if fuel injection is carried out through in-cylinder injector 110 alone, the engine speed and the load of engine 10 are so high and the intake air quantity so sufficient that it is readily possible to obtain a homogeneous air-fuel mixture using only in-cylinder injector 110. In this manner, the fuel injected from in-cylinder injector 110 is atomized in the combustion chamber involving latent heat of vaporization (or, absorbing heat from the combustion chamber). Thus, the temperature of the air-fuel mixture is decreased at the compression end, so that the anti-knocking performance is improved. Further, since the temperature in the combustion chamber is decreased, intake efficiency is improved, leading to high power.

In the map for the warm state in FIG. 9, fuel injection is also carried out using in-cylinder injector 110 alone when the load factor is KL(1) or less. This shows that in-cylinder injector 110 alone is used in a predetermined low-load region when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, in which case accumulation of deposits is prevented. Further, clogging at in-cylinder injector 110 may be prevented while ensuring the minimum fuel injection quantity thereof. Thus, in-cylinder injector 110 solely is used in the relevant region.

In comparison between FIG. 9 and FIG. 10, the region of "DI RATIO r=0%" is present only in the map for the cold state of FIG. 10. This shows that fuel injection is carried out through intake manifold injector 120 alone in a predetermined low-load region (KL(3) or less) when the temperature of engine 10 is low. When engine 10 is cold and low in load and the intake air quantity is small, the fuel is less susceptible to atomization. In such a region, it is difficult to ensure favorable combustion with the fuel injection from in-cylinder injector 110. Further, particularly in the low-load and low-speed region, high power using in-cylinder injector 110 is unnecessary. Accordingly, fuel injection is carried out through intake manifold injector 120 alone, without using in-cylinder injector 110, in the relevant region.

Further, in an operation other than the normal operation, or, in the catalyst warm-up state during idling of engine 10 (an abnormal operation state), in-cylinder injector 110 is controlled such that stratified charge combustion is effected. By causing the stratified charge combustion only during the catalyst warm-up operation, warming up of the catalyst is promoted to improve exhaust emission.

<Engine (2) to Which Present Control Apparatus is Suitably Adapted>

An engine (2) to which the control apparatus of the present embodiment is suitably adapted will be described hereinafter. In the following description of the engine (2), the configurations similar to those of the engine (1) will not be repeated.

Figure 11:
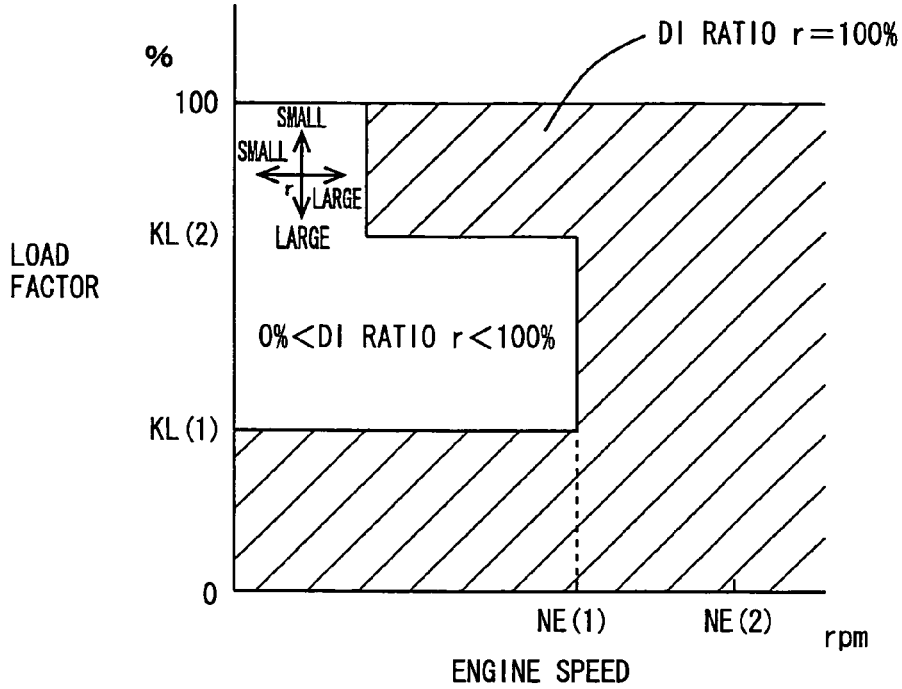
FIGS. 11 and 12 are second DI ratio maps corresponding to a warm state and a cold state, respectively, of an engine to which the control apparatus of an embodiment of the present invention is suitably adapted.
Figure 12:
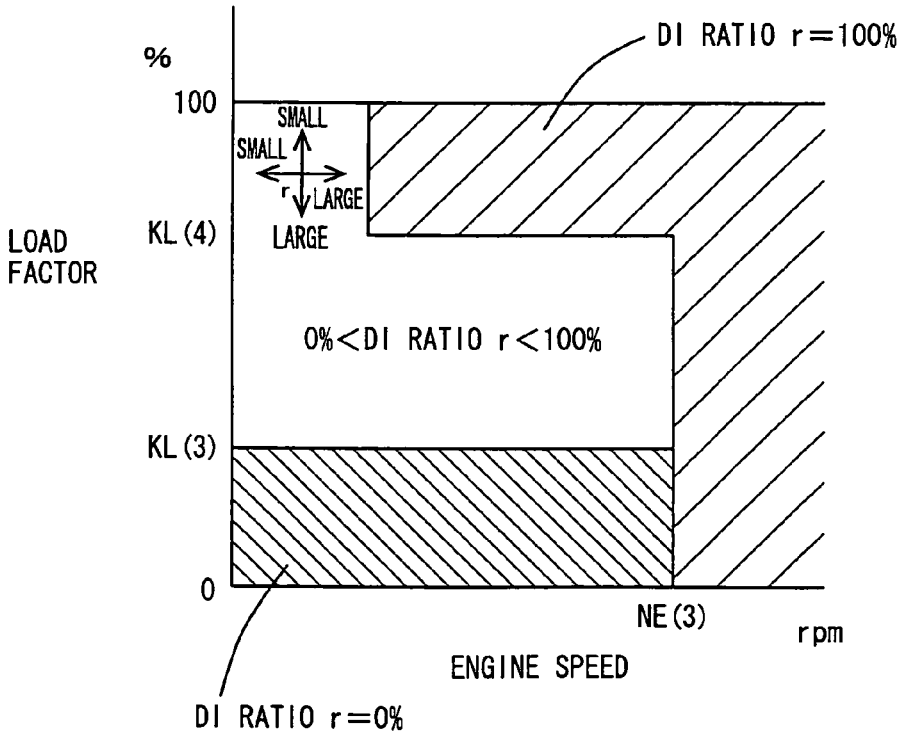

Referring to FIGS. 11 and 12, maps indicating the fuel injection ratio between in-cylinder injector 110 and intake manifold injector 120, identified as information associated with the operation state of engine 10, will be described. The maps are stored in ROM 320 of an engine ECU 300. FIG. 11 is the map for the warm state of engine 10, and FIG. 12 is the map for the cold state of engine 10.

FIGS. 11 and 12 differ from FIGS. 9 and 10 in the following points. "DI RATIO r=100%" holds in the region where the engine speed of engine 10 is equal to or higher than NE(1) in the map for the warm state, and in the region where the engine speed is NE(3) or higher in the map for the cold state. Further, "DI RATIO r=100%" holds in the region, excluding the low-speed region, where the load factor is KL(2) or greater in the map for the warm state, and in the region, excluding the low-speed region, where the load factor is KL(4) or greater in the map for the cold state. This means that fuel injection is carried out through in-cylinder injector 110 alone in the region where the engine speed is at a predetermined high level, and that fuel injection is often carried out through in-cylinder injector 110 alone in the region where the engine load is at a predetermined high level. However, in the low-speed and high-load region, mixing of an air-fuel mixture produced by the fuel injected from in-cylinder injector 110 is poor, and such inhomogeneous air-fuel mixture within the combustion chamber may lead to unstable combustion. Thus, the fuel injection ratio of in-cylinder injector 110 is to be increased as the engine speed increases where such a problem is unlikely to occur, whereas the fuel injection ratio of in-cylinder injector 110 is to be decreased as the engine load increases where such a problem is likely to occur. These changes in the DI ratio r are shown by crisscross arrows in FIGS. 11 and 12. In this manner, variation in output torque of the engine attributable to the unstable combustion can be suppressed. It is noted that these measures are substantially equivalent to the measures to decrease the fuel injection ratio of in-cylinder injector 110 in connection with the state of the engine moving towards the predetermined low speed region, or to increase the fuel injection ratio of in-cylinder injector 110 in connection with the engine state moving towards the predetermined low load region. Further, in a region other than the region set forth above (indicated by the crisscross arrows in FIGS. 11 and 12) and where fuel injection is carried out using only in-cylinder injector 110 (on the high speed side and on the low load side), the air-fuel mixture can be readily set homogeneous even when the fuel injection is carried out using only in-cylinder injector 110. In this case, the fuel injected from in-cylinder injector 110 is atomized in the combustion chamber involving latent heat of vaporization (by absorbing heat from the combustion chamber). Accordingly, the temperature of the air-fuel mixture is decreased at the compression end, whereby the antiknock performance is improved. Further, with the decreased temperature of the combustion chamber, intake efficiency is improved, leading to high power output.

In engine 10 described in conjunction with FIGS. 9-12, homogeneous combustion is realized by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in totality is ignited in the combustion chamber to realize the stratified charge combustion. Even if the fuel injection timing of in-cylinder injector 110 is set in the intake stroke, stratified charge combustion can be realized if a rich air-fuel mixture can be located locally around the spark plug.

As used herein, the stratified charge combustion includes both the stratified charge combustion and semi-stratified charge combustion set forth below. In the semi-stratified charge combustion, intake manifold injector 120 injects fuel in the intake stroke to generate a lean and homogeneous air-fuel mixture in totality in the combustion chamber, and then in-cylinder injector 110 injects fuel in the compression stroke to generate a rich air-fuel mixture around the spark plug, so as to improve the combustion state. Such a semi-stratified charge combustion is preferable in the catalyst warm-up operation for the following reasons. In the catalyst warm-up operation, it is necessary to considerably retard the ignition timing and maintain a favorable combustion state (idle state) so as to cause a high-temperature combustion gas to arrive at the catalyst. Further, a certain quantity of fuel must be supplied. If the stratified charge combustion is employed to satisfy these requirements, the quantity of fuel will be insufficient. With the homogeneous combustion, the retarded amount for the purpose of maintaining favorable combustion is small as compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine described in conjunction with FIGS. 9-12, the fuel injection timing by in-cylinder injector 110 is preferably set in the compression stroke for the reason set forth below. It is to be noted that, for most of the fundamental region (here, the fundamental region refers to the region other than the region where semi-stratified charge combustion is carried out with fuel injection from intake manifold injector 120 in the intake stroke and fuel injection from in-cylinder injector 110 in the compression stroke, which is carried out only in the catalyst warm-up state), the fuel injection timing of in-cylinder injector 110 is set at the intake stroke. The fuel injection timing of in-cylinder injector 110, however, may be set temporarily in the compression stroke for the purpose of stabilizing combustion, as will be described hereinafter.

When the fuel injection timing of in-cylinder injector 110 is set in the compression stroke, the air-fuel mixture is cooled by the fuel injection during the period where the temperature in the cylinder is relatively high. This improves the cooling effect and, hence, the antiknock performance. Further, when the fuel injection timing of in-cylinder injector 110 is set in the compression stroke, the time required starting from fuel injection up to the ignition is short, so that the air current can be enhanced by the atomization, leading to an increase of the combustion rate. With the improvement of antiknock performance and the increase of combustion rate, variation in combustion can be obviated to allow improvement in combustion stability.

Further, the warm map shown in FIG. 9 or 11 may be employed when in an off-idle mode (when the idle switch is off, when the accelerator pedal is pressed down), independent of the engine temperature (that is, independent of a warm state and a cold state). In other words, in-cylinder injector 110 is used in the low load region independent of the cold state and warm state.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine including a low-pressure pump supplying fuel of low pressure and a high-pressure pump supplying fuel of high pressure to a fuel injection mechanism from a fuel tank, comprising:

a determination unit determining that an operation state of said internal combustion engine is in an idle state, and a control unit controlling said internal combustion engine, wherein said control unit controls said low-pressure pump and said high-pressure pump depending upon which of two or more predetermined idle states said idle state belongs to.

2. The control apparatus for an internal combustion engine according to claim 1, wherein said control unit controls said internal combustion engine such that fuel increased in pressure by said high-pressure pump is supplied to said fuel injection mechanism when determination is made that said idle state is in a predetermined idle state of a lower load side.

3. The control apparatus for an internal combustion engine according to claim 1, wherein said control unit controls said internal combustion engine such that fuel increased in pressure by said high-pressure pump is supplied to said fuel injection mechanism when determination is made that said idle state is in a predetermined idle state of a lower speed side.

4. The control apparatus for an internal combustion engine according to claim 1, wherein said control unit controls said internal combustion engine such that increase of fuel in pressure by said high-pressure pump is suppressed, and fuel pressurized by said low-pressure pump is supplied to said fuel injection mechanism when determination is made that said idle state is in a predetermined idle state of a higher load side.

5. The control apparatus for an internal combustion engine according to claim 1, wherein said control unit controls said internal combustion engine such that increase of fuel in pressure by said high-pressure pump is suppressed, and fuel pressurized by said low-pressure pump is supplied to said fuel injection mechanism when determination is made that said idle state is in a predetermined idle state of a higher speed side.

6. The control apparatus for an internal combustion engine according to claim 1, wherein said fuel injection mechanism is a first fuel injection mechanism injecting fuel into a cylinder, said internal combustion engine further includes a second fuel injection mechanism injecting fuel into an intake manifold.

7. The control apparatus for an internal combustion engine according to claim 6, wherein said first fuel injection mechanism is an in-cylinder injector, and said second fuel injection mechanism is an intake manifold injector.

8. A control apparatus for an internal combustion engine including a low-pressure pump supplying fuel of low pressure and a high-pressure pump supplying fuel of high pressure to a fuel injection mechanism from a fuel tank, comprising:

a determination unit determining that an operation state of said internal combustion engine is in an idle state, a state determination unit determining a state of a fuel injection hole of said fuel injection mechanism, and a control unit controlling said internal combustion engine, wherein said control unit controls said internal combustion engine such that increase of fuel in pressure by said high-pressure pump is suppressed and fuel pressurized by said low-pressure pump is supplied to said fuel injection mechanism when determination is made that the operation state of said internal combustion engine is in an idle state, and determination is made that said fuel injection hole is in a normal state.

9. The control apparatus for an internal combustion engine according to claim 8, wherein said high-pressure pump includes a spill valve having its opening and closure controlled by said control unit, said control unit controls said high-pressure pump such that increase of fuel in pressure by said high-pressure pump is suppressed by reducing a frequency of closing said spill valve.

10. The control apparatus for an internal combustion engine according to claim 8, wherein said control unit controls said internal combustion engine such that fuel increased in pressure by said high-pressure pump is supplied to said fuel injection mechanism when determination is made that the operation state of said internal combustion engine is in an idle state, and determination is made that said fuel injection hole is not in a normal state.

11. A control apparatus for an internal combustion engine including a low-pressure pump supplying fuel of low pressure and a high-pressure pump supplying fuel of high pressure to a fuel injection mechanism from a fuel tank, comprising:

determination means for determining that an operation state of said internal combustion engine is in an idle state, and control means for controlling said internal combustion engine, wherein said control means includes means for controlling said low-pressure pump and said high-pressure pump depending upon which of two or more predetermined idle states said idle state belongs to.

12. The control apparatus for an internal combustion engine according to claim 11, wherein said control means includes means for controlling said internal combustion engine such that fuel increased in pressure by said high-pressure pump is supplied to said fuel injection mechanism when determination is made that said idle state is in a predetermined idle state of a lower load side.

13. The control apparatus for an internal combustion engine according to claim 11, wherein said control means includes means for controlling said internal combustion engine such that fuel increased in pressure by said high-pressure pump is supplied to said fuel injection mechanism when determination is made that said idle state is in a predetermined idle state of a lower speed side.

14. The control apparatus for an internal combustion engine according to claim 11, wherein said control means includes means for controlling said internal combustion engine such that increase of fuel in pressure by said high-pressure pump is suppressed and fuel pressurized by said low-pressure pump is supplied to said fuel injection mechanism when determination is made that said idle state is in a predetermined idle state of a higher load side.

15. The control apparatus for an internal combustion engine according to claim 11, wherein said control means includes means for controlling said internal combustion engine such that increase of fuel in pressure by said high-pressure pump is suppressed and fuel pressurized by said low-pressure pump is supplied to said fuel injection mechanism when determination is made that said idle state is in a predetermined idle state of a higher speed side.

16. The control apparatus for an internal combustion engine according to claim 11, wherein said fuel injection mechanism is a first fuel injection mechanism to inject fuel into a cylinder, and said internal combustion engine further includes a second fuel injection mechanism to inject fuel into an intake manifold.

17. The control apparatus for an internal combustion engine according to claim 16, wherein said first fuel injection mechanism is an in-cylinder injector, and said second fuel injection mechanism is an intake manifold injector.

18. A control apparatus for an internal combustion engine including a low-pressure pump supplying fuel of low pressure and a high-pressure pump supplying fuel of high pressure to a fuel injection mechanism from a fuel tank, comprising:

determination means for determining that an operation state of said internal combustion engine is in an idle state, state determination means for determining a state of a fuel injection hole of said fuel injection mechanism, and control means for controlling said internal combustion engine, wherein said control means includes means for controlling said internal combustion engine such that increase of fuel in pressure by said high-pressure pump is suppressed and fuel pressurized by said low-pressure pump is supplied to said fuel injection mechanism when determination is made that the operation state of said internal combustion state is in an idle state, and determination is made that said fuel injection hole is in a normal state.

19. The control apparatus for an internal combustion engine according to claim 18, wherein said high-pressure pump includes a spill valve having its opening and closure controlled by said control means, and said control means includes means for controlling said high-pressure pump to suppress increase of fuel in pressure by said high-pressure pump by reducing a frequency of closing said spill valve.

20. The control apparatus for an internal combustion engine according to claim 18, wherein said control means includes means for controlling said internal combustion engine such that fuel increased in pressure by said high-pressure pump is supplied to said fuel injection mechanism when determination is made that the operation state of said internal combustion engine is in an idle state, and determination is made that said fuel injection hole is not in a normal state.

21. A control apparatus for an internal combustion engine including a low-pressure pump supplying fuel of low pressure and a high-pressure pump supplying fuel of high pressure to an in-cylinder injector that injects fuel into a cylinder from a fuel tank, said control apparatus comprising an electronic control unit (ECU), wherein said electronic control unit (ECU)

determines that an operation state of said internal combustion engine is in an idle state, and controls said low-pressure pump and said high-pressure pump depending upon which of two or more predetermined idle states said idle state belongs to.

22. A control apparatus for an internal combustion engine including a low-pressure pump supplying fuel of low pressure and a high-pressure pump supplying fuel of high pressure to an in-cylinder injector that injects fuel into a cylinder from a fuel tank, said control apparatus comprising an electronic control unit (ECU), wherein said electronic control unit (ECU)

determines that an operation state of said internal combustion engine is in an idle state, determines a state of a fuel injection hole of said fuel injection mechanism, and controls said internal combustion engine such that increase of fuel in pressure by said high-pressure pump is suppressed and fuel pressurized by said low-pressure pump is supplied to said in-cylinder injector when determination is made that the operation state of said internal combustion engine is in an idle state, and determination is made that said fuel injection hole is in a normal state.

* * * * *